US009845655B2

(12) United States Patent
Hoefler et al.

(10) Patent No.: US 9,845,655 B2
(45) Date of Patent: Dec. 19, 2017

(54) SYSTEM AND METHOD FOR TESTING AN INSERT PACKER ASSEMBLY

(71) Applicant: Cameron International Corporation, Houston, TX (US)

(72) Inventors: John Hoefler, Cypress, TX (US); Erman Citirik, Houston, TX (US); James Chris Reed, Humble, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/872,902

(22) Filed: Oct. 1, 2015

(65) Prior Publication Data

US 2017/0096871 A1 Apr. 6, 2017

(51) Int. Cl.

| | |
|---|---|
| ***E21B 33/06*** | (2006.01) |
| ***E21B 33/126*** | (2006.01) |
| ***E21B 21/08*** | (2006.01) |
| ***E21B 7/20*** | (2006.01) |
| ***G01M 3/02*** | (2006.01) |
| ***E21B 47/10*** | (2012.01) |
| ***E21B 21/02*** | (2006.01) |
| ***G01M 3/28*** | (2006.01) |
| ***G01M 13/00*** | (2006.01) |
| ***E21B 33/12*** | (2006.01) |
| ***E21B 17/01*** | (2006.01) |
| ***E21B 47/00*** | (2012.01) |

(52) U.S. Cl.

CPC ..... *E21B 33/12* (2013.01); *E21B 17/01* (2013.01); *E21B 47/00* (2013.01)

(58) Field of Classification Search

None

See application file for complete search history.

(56) References Cited

U.S. PATENT DOCUMENTS

| | | | | |
|---|---|---|---|---|
| 3,387,851 | A | 6/1968 | Cugini | |
| 3,490,525 | A * | 1/1970 | Nettles | E21B 33/06 166/97.1 |
| 4,817,724 | A * | 4/1989 | Funderburg, Jr. | E21B 21/001 166/187 |
| 4,971,148 | A * | 11/1990 | Roche | E21B 33/03 166/82.1 |
| 5,273,108 | A | 12/1993 | Piper | |

(Continued)

OTHER PUBLICATIONS

PCT International Search Report & Written Opinion for PCT Application No. PCT/US2016/054886 dated Feb. 22, 2017; 13 Pages.

*Primary Examiner* — Matthew R Buck
*Assistant Examiner* — Douglas S Wood
(74) *Attorney, Agent, or Firm* — Fletcher Yoder, P.C.

(57) ABSTRACT

A method for testing an insert packer assembly positioned within a diverter assembly includes inserting a test tool through an opening of the insert packer assembly and into a bore of the diverter assembly. The method includes driving multiple annular flexible components of the insert packer assembly radially inward to contact an outer annular surface of the test tool to form a sealed space between the multiple annular flexible components and the outer annular surface of the test tool. The method also includes applying a fluid to the sealed space to increase a pressure within the sealed space and monitoring the pressure within the sealed space over a period of time to determine a condition of the insert packer assembly.

21 Claims, 9 Drawing Sheets

(56) References Cited

U.S. PATENT DOCUMENTS

| | | | | |
|---|---|---|---|---|
| 5,283,108 | A * | 2/1994 | Haddick | H05K 1/0346 156/306.9 |
| 9,448,132 | B2 * | 9/2016 | Weaver | G01M 3/02 |
| 2011/0024195 | A1 | 2/2011 | Hoyer | |
| 2013/0299238 | A1 | 11/2013 | Weaver | |

* cited by examiner

SYSTEM AND METHOD FOR TESTING AN INSERT PACKER ASSEMBLY

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. A drilling system may include a riser that connects a drilling rig to a wellhead assembly through which the resource is extracted. A drill string can be run from the drilling rig through the riser to a well. Drilling mud can be directed into the well through the drill string and returns to the surface via an annulus between the drill string and the riser. A diverter may be provided to seal a return path through the riser and/or to redirect formation fluid away from the drilling rig, thereby protecting the equipment disposed above the diverter. It would be desirable to reliably and efficiently test the ability of the diverter to seal the return path through the riser.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods for testing an insert packer assembly (e.g., an assembly of one or more annular seals or annular insert packers) of a diverter assembly of a drilling system. During drilling operations, the insert packer assembly of the diverter assembly may be replaced at various times to accommodate a particular drill string extending through the diverter assembly (e.g., a new drill string having a different circumference), for example. When the insert packer assembly of the diverter assembly is replaced, it may be desirable to test a condition of the insert packer assembly (e.g., to monitor whether the insert packer assembly forms a seal about the drill string and adequately blocks a flow of fluid through an annulus of the diverter assembly). The disclosed embodiments help to improve the efficiency and reliability of testing insert packers. For example, without the disclosed embodiments, the insert packer may require removal following completion of the test in order to withdraw a testing tool from the diverter assembly, and thus the insert packer may require subsequent reinstallation in the diverter assembly prior to drilling operations.

With the foregoing in mind, certain exemplary embodiments of the present disclosure include a system having an insert packer assembly with multiple annular flexible components (e.g., elastomer sealing components) and/or a tool (e.g., an insert packer test tool) that is configured to enable reliable, efficient testing of the insert packer assembly.

Certain exemplary embodiments include a method of using the tool to test the insert packer assembly. In certain embodiments, the disclosed systems and methods may enable testing of the insert packer assembly without subsequent removal of the insert packer assembly from the diverter assembly (i.e., the tool may be withdrawn from the diverter assembly while the insert packer assembly remains in place within the diverter assembly).

Figure 1:
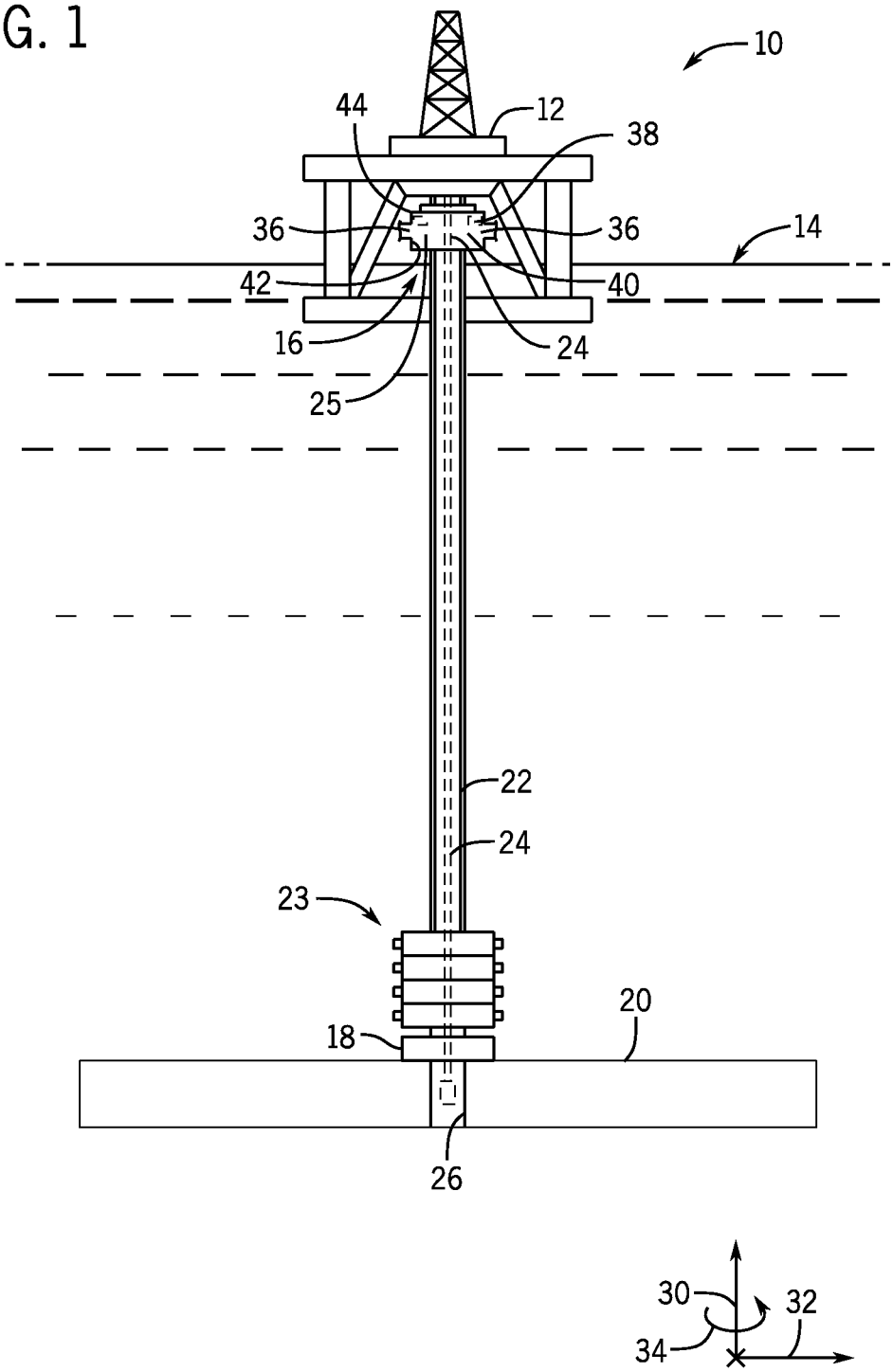
FIG. 1 is a schematic diagram of an offshore system in accordance with an embodiment of the present disclosure.

With the foregoing in mind, FIG. 1 is an embodiment of an offshore system 10. The offshore system 10 includes an offshore vessel or platform 12 at a sea surface 14. A diverter assembly 16 is positioned above a wellhead 18 at a sea floor 20. A tubular drilling riser 22 may extend from the diverter assembly 16 toward the wellhead 18, and the riser 22 may return drilling fluid or mud to the platform 12 during drilling operations. Downhole operations are carried out by a tubular string 24 (e.g., drill string, production tubing string, or the like) that extends from the platform 12, through a bore 25 of the diverter assembly 16, through the riser 22, through a blowout preventer assembly 23, and into a wellbore 26.

To facilitate discussion, the diverter assembly 16 and its components may be described with reference to an axial axis or direction 30, a radial axis or direction 32, and a circumferential axis or direction 34. As shown, the diverter assembly 16 includes one or more outlets 36 extending radially outward from the bore 25. The diverter assembly 16 also includes an insert packer assembly 38 (e.g., an assembly of one or more annular seals or annular insert packers) configured to seal an annulus 40 between the tubular string 24 and an inner wall 42 of a body 44 of the diverter assembly 16. When the insert packer assembly 38 seals the annulus 40 (i.e., when the insert packer assembly 38 is in a sealed position in which at least a portion of the insert packer assembly 38 contacts the tubular string 24), the drilling fluid or mud in the annulus 40 may be directed (e.g., diverted) away from the platform 12 through the one or more outlets 36.

As noted above, it may be desirable to change the insert packer assembly 38 based on a circumference of the tubular string 24, for example. Accordingly, at various times, an operator may remove one insert packer assembly 38 and install another insert packer assembly 38 having appropriate dimensions for the particular tubular string 24 that will be used during the drilling operations. Upon installation of a new insert packer assembly 38, it may be desirable to efficiently and reliably test the insert packer assembly 38 to determine whether the insert packer assembly 38 effectively seals the annulus 40 and adequately blocks the flow of drilling fluid, mud, or other fluids. Accordingly, the disclosed embodiments include a system having the insert packer assembly 38 and/or a tool (e.g., an insert packer test tool) to facilitate testing the insert packer assembly 38, and a method of using the tool to test the insert packer assembly 38.

Figure 2:
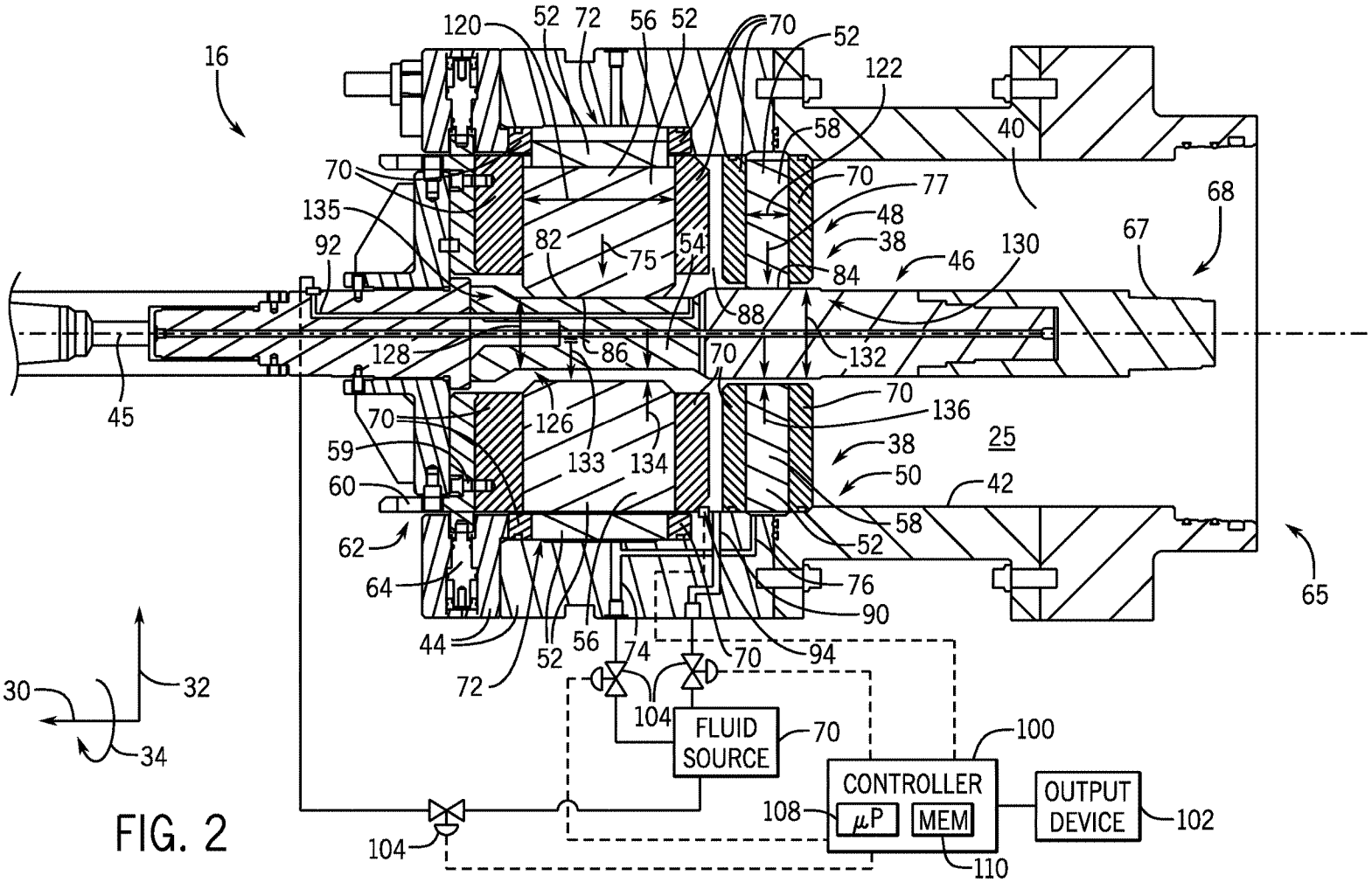
FIG. 2 is a cross-sectional side view of an embodiment of a portion of a diverter assembly having an insert packer and a test packer that may be used in the offshore system of FIG. 1.

FIG. 2 is a cross-sectional side view of an embodiment of a portion of the diverter assembly 16 having the insert packer assembly 38 and a tool 46 (e.g., an insert packer test tool) positioned within the bore 25 of the diverter assembly 16. In particular, FIG. 2 illustrates a split view of the portion of the diverter assembly 16 that is divided along a central axis 45 of the diverter assembly 16. The portion of the diverter assembly 16 above the central axis 45 shows the insert packer assembly 38 in a sealed position 48 (e.g., closed position), and the portion of the diverter assembly 16 below the central axis 45 shows the insert packer assembly 38 in an unsealed position 50 (e.g., open position). As discussed in more detail below, in the sealed position 48, annular flexible components 52 (e.g., elastic components) of the insert packer assembly 38 are in a first position and/or contact a shaft 54 of the tool 46. In the unsealed position 50, the flexible components 52 are in a second position and/or do not contact the shaft 54 of the tool 46.

The insert packer assembly 38 and the tool 46 may be configured to facilitate efficient, reliable testing of the seal formed by the insert packer assembly 38. As shown, the insert packer assembly 38 includes an insert packer 56 (e.g., an annular insert packer, a primary insert packer, or a primary annular seal) and a test packer 58 (e.g., an annular test packer, a secondary insert packer, or a secondary annular seal) that are each positioned within the body 44 of the diverter assembly 16 and are configured to extend circumferentially about the shaft 54 of the tool 46 during testing procedures. The insert packer 56 and/or the test packer 58 may be coupled to the body 44 of the diverter assembly 16 via any suitable fastener. For example, in the illustrated embodiment, the insert packer 54 is mounted to a support structure 60 disposed at a proximal end 62 (e.g., upper end) of the diverter assembly 16 via one or more threaded fasteners 59, and the support structure 60 is coupled to the body 44 of the diverter assembly 16 via one or more threaded fasteners 64.

The test packer 58 and the insert packer 56 may be coaxial and may be stacked relative to one another along the axial axis 30. As shown, the insert packer 56 is positioned at the proximal end 62 of the diverter assembly 16, and the test packer 58 is positioned between the insert packer 56 and a distal end 65 (e.g., lower end) of the diverter assembly 16 (e.g., between the insert packer 56 and the wellbore 26 during drilling operations), although in other embodiments, the test packer 58 may be positioned at the proximal end 62 and the insert packer 56 may be positioned between the test packer 58 and the distal end 65. The tool 46 may include threads 67 or other attachment components at a distal end 68 of the tool 46 that are configured to receive or to attach to a variety of tubular members (e.g., customer-specific or well-specific tubular members), which may support the tool 46 within the diverter assembly 16 during testing procedures. In the illustrated embodiment, the insert packer 56 and the test packer 58 include respective flexible components 52 (e.g., an annular flexible or elastic component) disposed axially between respective rigid components 70 (e.g., annular rigid components). The flexible components 52 may be formed from an elastomer, rubber, or any suitable elastic material, and the rigid components 70 may be formed from steel or any suitable metal or non-elastic material.

The rigid components 70 may be fixed relative to the body 44 of the diverter assembly 16, and the flexible components 52 may be configured to move relative to the body 44 of the diverter assembly 16. In some embodiments, a fluid source 70 may be configured to provide a fluid (e.g., a liquid or a gas) to directly or indirectly drive the respective flexible components 52 of the insert packer 56 and/or the test packer 58 radially inward (e.g., along the radial axis 32) away from the inner wall 42 of the body 44 of the diverter assembly 16. As discussed in detail below, during testing, the fluid may drive the respective flexible components 52 of the insert packer 56 and/or the test packer 58 radially inward toward the shaft 54 of the tool 46 to facilitate testing of a seal across the annulus 40 formed by the insert packer 56 and/or the test packer 58. During drilling operations, the fluid may drive the respective flexible components 52 of the insert packer 56 and/or the test packer 58 radially inward toward the tubular string 24, thereby sealing the annulus 40 of the diverter assembly 16 and blocking a flow of drilling fluid through the annulus 40.

In the illustrated embodiment, a diverter packer 72 is coupled to the body 44 of the diverter assembly 16. The diverter packer 72 includes a respective flexible component 52 and respective rigid components 70, and the respective flexible component 52 of the diverter packer 72 is axially aligned with the respective flexible component 52 of the insert packer 56. Thus, when fluid is applied to the respective flexible component 52 of the diverter packer 72 via a first line 74, the respective flexible components 52 of the diverter packer 72 and the insert packer 56 are driven radially inward toward the shaft 54 of the tool 46, as shown by arrow 75. Additionally, in the illustrated embodiment, a second line 76 may provide the fluid to the flexible component 52 of the test packer 58, thereby directly driving the flexible component 52 of the test packer 58 radially inward toward the shaft 54 of the tool 46, as shown by arrow 77. As shown, the second line 76 branches from the first line 74. However, the first line 74 and the second line 76 may separately extend from the fluid source 70 or have any suitable configuration for providing the fluid from the fluid source 70 to drive the respective flexible components 52 of the insert packer assembly 38.

It should be understood that in some embodiments, the first line 74 and/or the second line 76 may apply the fluid directly to the respective flexible components 52 of the insert packer 56 and/or the test packer 58 (i.e., the diverter packer 72 may not be provided). Furthermore, in some embodiments, a diverter packer may be aligned with the test packer 58, and the first line 74 and/or the second line 76 may apply the fluid to respective diverter packers 72 to indirectly drive the flexible components 52 of the insert packer 56 and/or the test packer 58 radially inward.

As shown in FIG. 2, when the insert packer 56 and the test packer 58 are in the sealed position 48, an inner wall 82 (e.g., a radially-inner wall) of the flexible component 52 of the insert packer 56 and an inner wall 84 (e.g., a radially-inner wall) of the flexible component 52 of the test packer 58 each contact an outer wall 86 (e.g., a radially-outer wall) of the tool 46, thereby forming a space 88 (e.g., an annular space, a sealed space, a chamber, a fluid chamber, or a hydraulic chamber). To test a condition of the insert packer 56 and/or the test packer 58 (e.g., to test whether the insert packer 56 and/or the test packer 58 adequately seal the annulus 40), a fluid (e.g., a liquid or a gas) may be provided to increase a pressure within the space 88. In some embodiments, the fluid may be provided via a third line 90. In the illustrated embodiment, the third line 90 extends through the body 44 of the diverter assembly 16 to the space 88. In addition to or as an alternative to the third line 90, a fourth line 92 may extend through the tool 46 to the space 88 to provide the fluid to the space 88, in certain embodiments. Any of the various fluid lines (e.g., fluid lines 74, 76, 90, 92), the fluid source 70, the flexible components 52, and/or the space 88 disclosed herein may be part of a fluid actuator, such as a hydraulic actuator, or a fluid drive, such as a hydraulic drive, configured to facilitate testing of the insert packer assembly 38.

A sensor 94 (e.g., a pressure sensor) may be positioned in the space 88 and may be configured to monitor the pressure within the space 88. The sensor 94 may be coupled to the body 44 of the diverter assembly 16, the shaft 54 of the tool 46, or any other suitable structure that enables the sensor 94 to monitor the pressure within the space 88. If the insert packer assembly 38 adequately seals the annulus 40, the pressure within the space 88 may be maintained (e.g., may not change significantly over a period of time, such as 1, 3, 5, 10, or more minutes). However, if the insert packer assembly 38 does not adequately seal the annulus 40, the pressure may change over the period of time (e.g., may decrease by more than 3, 5, 10, or 15 percent within 1, 3, 5, or 10 minutes).

As shown, a controller 100 (e.g., electronic controller) may be provided to receive and to process signals generated by the sensor 94. In some embodiments, the controller 100 may be configured to determine whether the insert packer assembly 38 adequately seals the annulus 40 based on the signals received from the sensor 94, and the controller 100 may be configured to provide an output to an output device 102 (e.g., a displayed output via a display and/or an audible output via a speaker) indicative of the condition (e.g., whether the seal formed by the insert packer assembly 38 is adequate) of the insert packer assembly 38. In some embodiments, the controller 100 may be configured to provide control signals to one or more valve assemblies 104 to adjust a flow of the fluid to the first line 74, the second line 76, the third line 90, and/or the fourth line 92. For example, the controller 100 may be configured to direct the fluid to the first line 74 and the second line 76, and then subsequently direct the fluid to the third line 90 and/or the fourth line 92 to facilitate testing the insert packer assembly 38. In some embodiments, the controller 100 may be configured to initiate the testing procedure (i.e., control the one or more valve assemblies 104 to adjust the flow of the fluid, monitor the pressure within the space 88, process signals from the sensor 94 to determine the condition of the insert packer assembly 38, or the like) in response to a user input or upon insertion of the tool 46 within the diverter assembly 16.

In certain embodiments, the controller 100 is an electronic controller having electrical circuitry configured to process data from various components of the diverter assembly 16. In the illustrated embodiment, the controller 100 includes a processor, such as the illustrated microprocessor 108, and a memory device 110. The controller 100 may also include one or more electronic data storage devices and/or other suitable components. The processor 108 may be used to execute software, such as software for controlling the one or more valve assemblies 104 to adjust a flow of the fluid, for processing signals from the sensor 94, for providing an output indicative of the condition of the insert packer assembly 38, and so forth. Moreover, the processor 108 may include multiple microprocessors, one or more "general-purpose" microprocessors, one or more special-purpose microprocessors, and/or one or more application specific integrated circuits (ASICS), or some combination thereof. For example, the processor 108 may include one or more reduced instruction set (RISC) processors.

The memory device 110 may include a volatile memory, such as random access memory (RAM), and/or a nonvolatile memory, such as read only memory (ROM). The memory device 110 may store a variety of information and may be used for various purposes. For example, the memory device 110 may store processor-executable instructions (e.g., firmware or software) for the processor 108 to execute, such as instructions for controlling the one or more valve assemblies 104 or for processing signals from the sensor 94. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., pressure data, etc.), instructions (e.g., software or firmware for controlling the one or more valve assemblies 104, processing signals from the sensor 94, etc.), and any other suitable data.

In some embodiments, the test packer 58 may only be utilized for testing the sealing ability of the insert packer 56 (i.e., the test packer 58 may not be driven radially inwardly to contact the tubular string 24 and/or fluid may not be applied to the test packer 58 during drilling operations). However, in some embodiments, both the insert packer 56 and the test packer 58 are utilized for testing and for sealing the annulus 40 during drilling operations. Accordingly, certain disclosed embodiments may advantageously include the insert packer assembly 38 having two physically separate insert packers (e.g., the insert packer 56 and the test packer 58) and/or two distinct axially-spaced (e.g., non-contacting and separated from one another along the axial axis 30) flexible components 52 to form the space 88 to facilitate testing and/or to seal the annulus 40 during drilling operations.

In the illustrated embodiment, the respective flexible components 52 of the insert packer 56 and the test packer 58 have different lengths. For example, the flexible component 52 of the insert packer 56 has a first length 120 and the flexible component 52 of the test packer 58 has a second length 122, less than the first length 120. In some embodiments, the second length 122 may be less than approximately 10, 20, 30, 40, 50, 60, 70, 80, or 90 percent of the first length 120. In some embodiments, the second length 122 may be between approximately 10-90, 20-80, 30-70, or 40-60 percent of the first length 120. In some embodiments, the first length 120 may be less than the second length 122, or the first length 120 and the second length 122 may be approximately equal to one another. The insert packer 56 and/or the test packer 58 may be sized to enable use of the disclosed insert packer assembly 38 within existing diverter assemblies 16 and/or within a limited length available within diverter assemblies 16. In some embodiments, the second length 122 may be small enough to enable use of the test packer 58 in conjunction with typical or existing insert packers 56 (i.e., to fit within the limited length available within diverter assemblies 16). Such lengths and sizes may enable the insert packer assembly 38 to provide an adequate seal and to facilitate testing the seal formed by the insert packer assembly 38.

In the depicted embodiment, the shaft 54 of the tool 46 has a stepped outer wall 86 (e.g., a first portion 126 of the shaft 54 has a first diameter 128 greater than a second portion 130 of the shaft 54 that has a second diameter 132, greater than the first diameter 128). The stepped outer wall 86 may facilitate testing the insert packer 56 and the test packer 58 having respective flexible components 52 of different sizes, as discussed above. For example, the relatively large first length 120 of the flexible component 52 of the insert packer 56 may enable the flexible component 52 to flex (e.g., move) radially inward a first distance 134, while the relatively small second length 122 of the flexible component 52 of the test packer 58 may enable the flexible component 52 to flex radially inwardly a second distance 136, smaller than the first distance 134. Thus, the stepped outer wall 86 may facilitate contact between the flexible components 52 and the shaft 54 for testing the sealing ability of the insert packer assembly 38.

While FIG. 2 illustrates the stepped outer wall 86, in some embodiments, the first and second portions 126, 130 of the shaft 54 (e.g., the portions of the shaft 54 disposed within the insert packer assembly 38 during testing) may be generally cylindrical and have a substantially constant diameter. In some such cases, a relatively greater pressure may be applied to the shorter flexible component 52 (e.g., the flexible component 52 of the test packer 58) than to the longer flexible component 52 (e.g., the flexible component 52 of the insert packer 56) such that the flexible components 52 of both the insert packer 56 and the test packer 58 are urged radially inward to contact the shaft 54 for testing.

The configuration of the insert packer assembly 38 and the tool 46 enable efficient, reliable testing of the insert packer assembly 38 by monitoring pressure changes between multiple axially-spaced flexible components 52. Additionally, the configuration of these components advantageously enables insertion and withdrawal of the tool 46 into the diverter assembly 16 without disturbing the installed insert packer assembly 38. For example, because a largest diameter (e.g., diameter 132) of the shaft 54 of the tool 46 that passes through the insert packer assembly 38 is smaller than an inner diameter 133 of an opening 135 (e.g., annulus) of the insert packer assembly 38 when the insert packer assembly 38 is in the open position 50 (e.g., the flexible components 52 are in the second position), the tool 46 may be inserted into and withdrawn from the diverter assembly 16 without removing the insert packer assembly 38.

Figure 3:
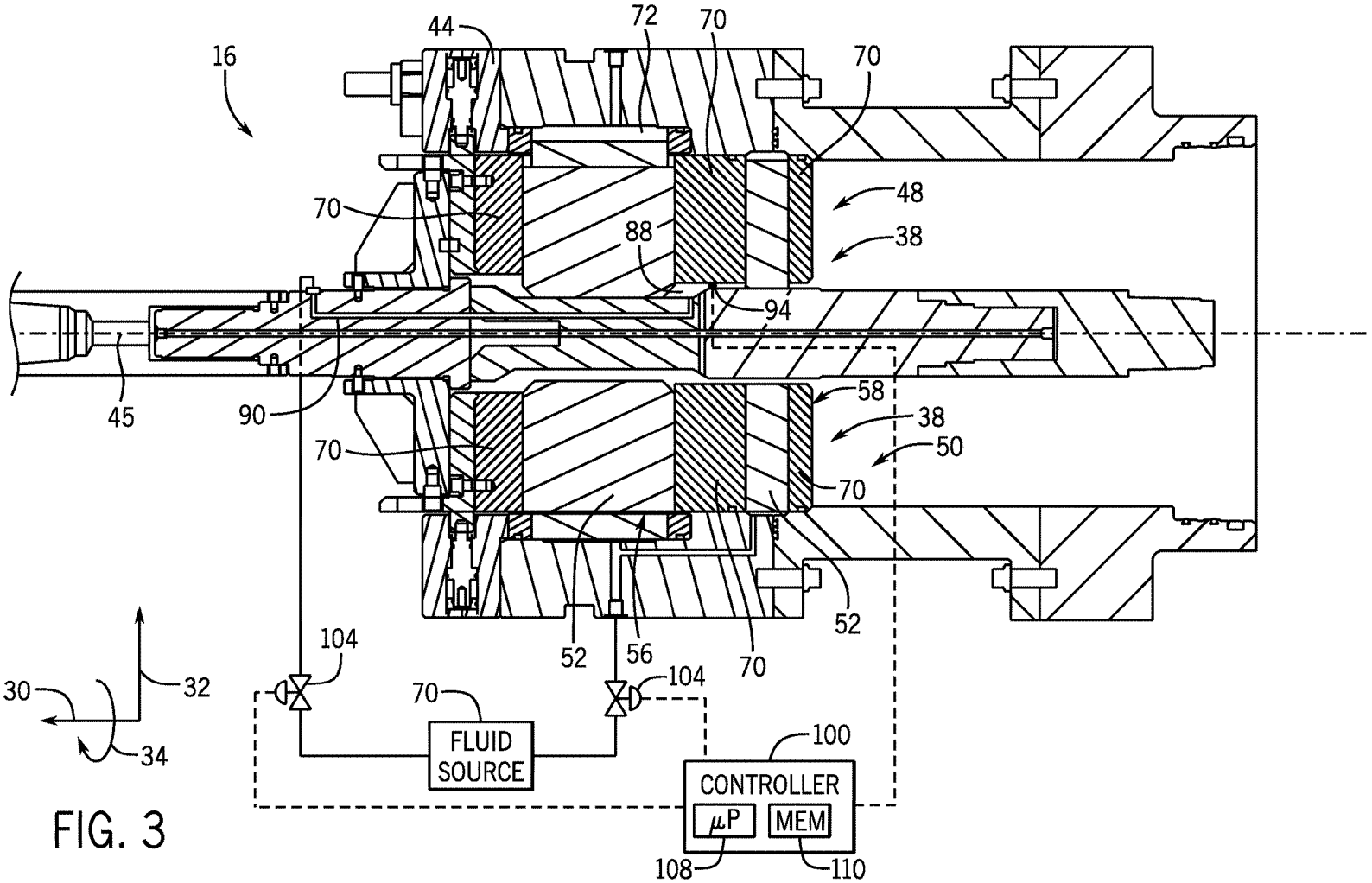
FIG. 3 is a cross-sectional side view of a portion of a diverter assembly having a one-piece insert packer assembly that may be used in the offshore system of FIG. 1.

FIG. 3 is a cross-sectional side view of an embodiment of a portion of the diverter assembly 16 having a one-piece insert packer assembly 38. As shown, the insert packer 56 and the test packer 58 are coupled to one another (e.g., fixed to one another) or are integrally formed into a single structure. For example, the one-piece insert packer assembly 38 includes two physically separate and distinct axially-spaced flexible components 52 (e.g., non-contacting and separated from one another along the axial axis 30). As shown, the flexible components 52 are separated from one another by a single rigid component 70 that extends between and contacts the two flexible components 52.

As discussed above, the fluid may be provided to drive the flexible components 52 radially inward to contact the shaft 54 of the tool 46 and to form the space 88. Thus, as shown, the space 88 is formed between the flexible components 52, the outer wall 86 of the shaft 54 of the tool 46, and the intermediate rigid component 70. In the illustrated embodiment, the tool 46 may include a conduit (e.g., the fourth line 90) configured to provide a pressurized fluid to the space 88. The sensor 94 may be disposed within the space 88. In some embodiments, the sensor 94 may be coupled to the shaft 54 of the tool 46. The sensor 94 may monitor the pressure within the space 88, and the processor 108 of the controller 100 may be configured to receive and to process signals from the sensor 94, as discussed above. As discussed above, the flexible components 52 may have any of a variety of lengths and the shaft 54 may have any suitable geometry (e.g., a stepped outer wall 86 or a constant diameter) to enable testing the insert packer assembly 38.

Figure 4:
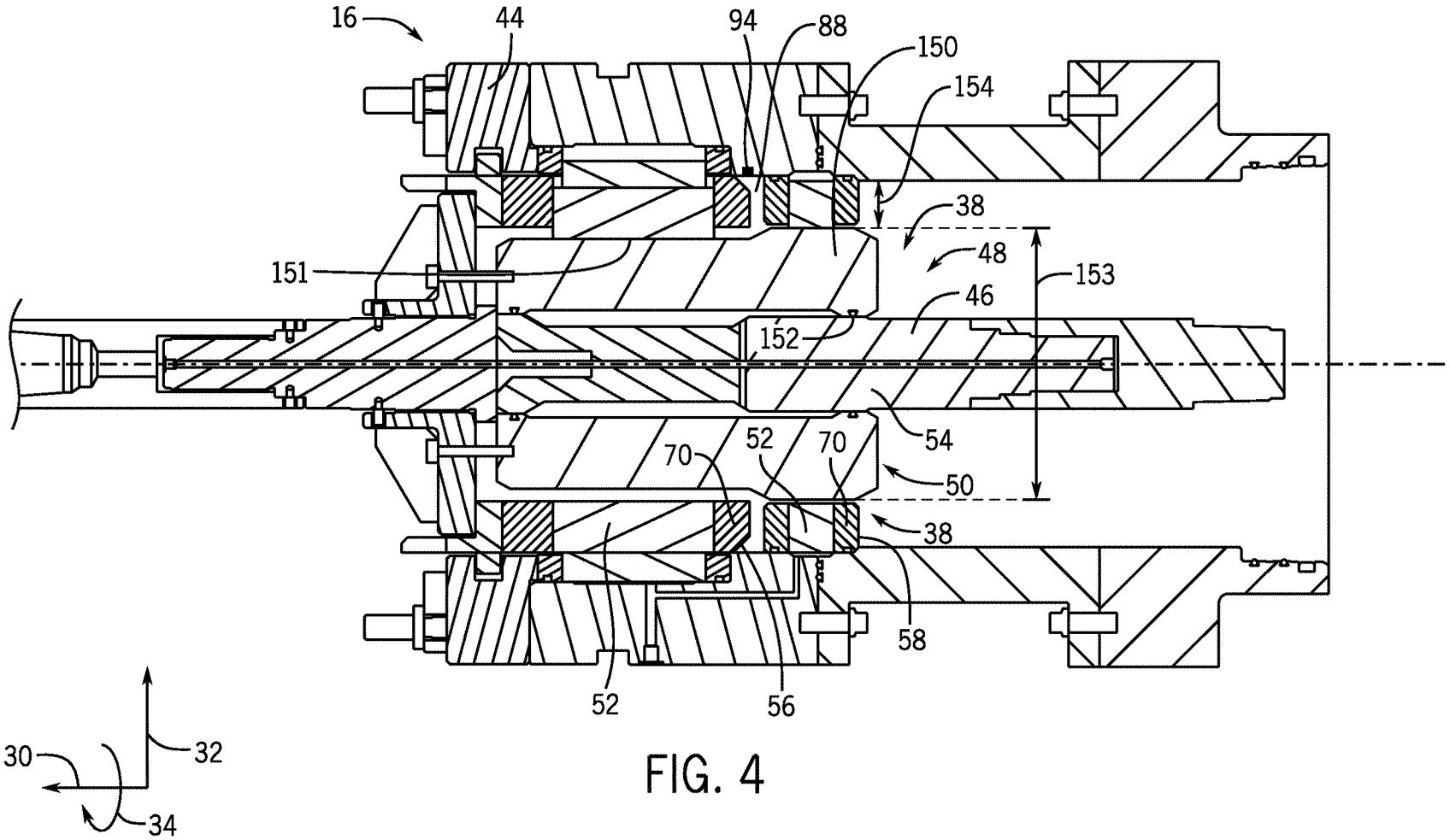
FIG. 4 is a cross-sectional side view of a portion of a diverter assembly that may be used in the offshore system of FIG. 1, wherein a tool having an extension piece is disposed within the diverter assembly.

FIG. 4 is a cross-sectional side view of an embodiment of a portion of the diverter assembly 16 having the tool 46 with an extension piece 150 (e.g., an annular extension piece). The extension piece 150 may be fixed (e.g., welded) to the shaft 54 of the tool 46 or removably coupled to the shaft 54 via any suitable fastener (e.g., a threaded fastener 152). When the flexible components 52 are driven into the sealed position 48 (e.g., first position) in which the flexible components 52 contact an outer wall 151 of the extension piece 150, the space 88 is formed between the insert packer 56, the test packer 58, the body 44, and the extension piece 150.

The extension piece 150 may expand a diameter 153 of the shaft 54, thereby enabling testing insert packer assemblies 38 of any of a variety of corresponding thicknesses 154. In some embodiments, multiple extension pieces 150 of various dimensions may be provided to facilitate testing various insert packer assemblies 38. Although the fluid source 70 and controller 100 are not depicted, these components and other components illustrated in FIGS. 2 and 3 may be provided to facilitate testing of the insert packer assembly 38, as discussed above. Additionally, as discussed above, the flexible components 52 may have any of a variety of lengths and the extension piece 150 may have any suitable geometry (e.g., a stepped outer wall 151 or a constant diameter) to enable testing of the insert packer assembly 38. Additionally, the extension piece 150 may be utilized in conjunction with the one-piece insert packer assembly 38 discussed above with reference to FIG. 3.

Figure 5:
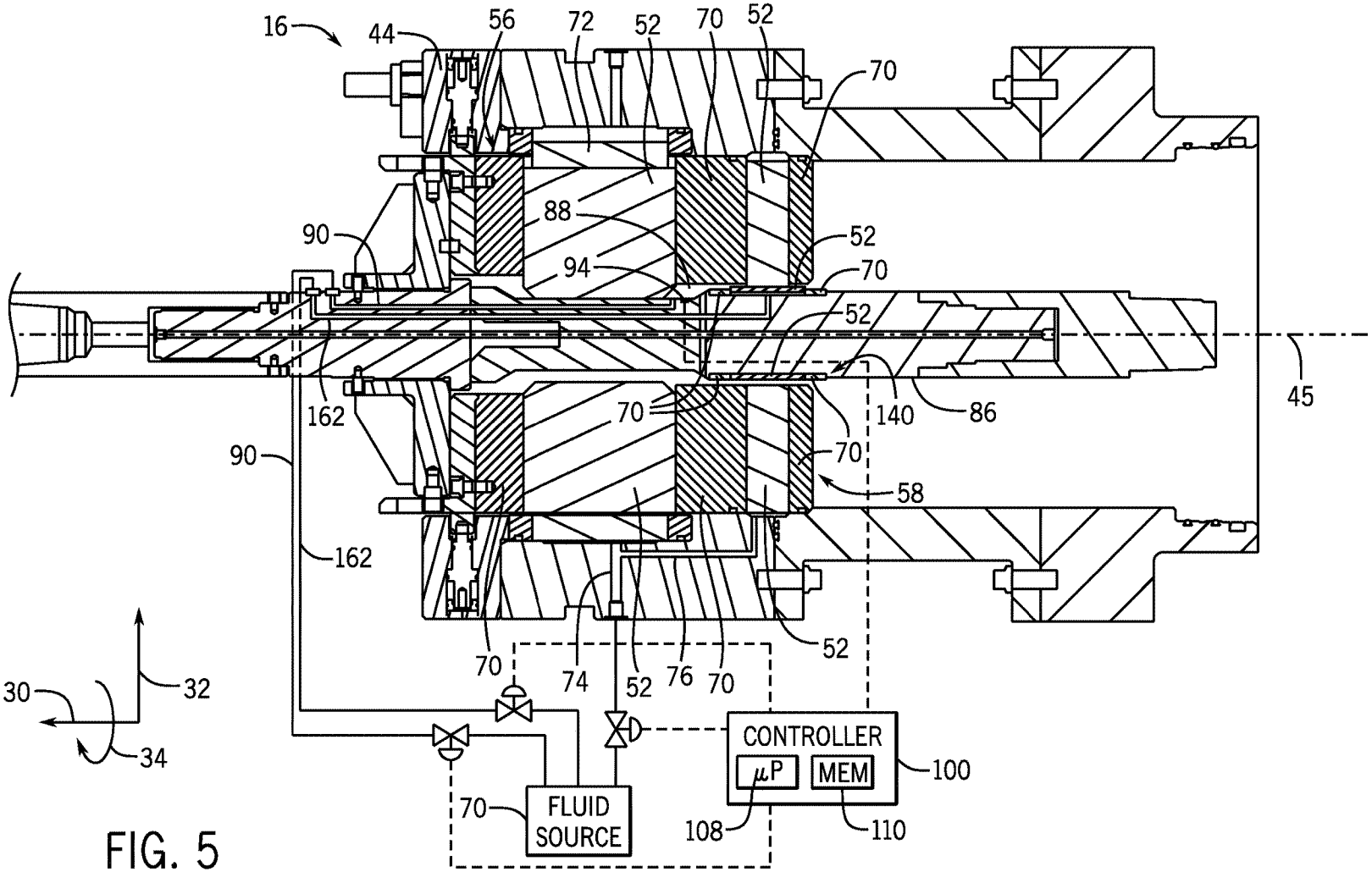
FIG. 5 is a cross-sectional side view of a portion of a diverter assembly that may be used in the offshore system of FIG. 1, wherein a tool having a test tool packer is disposed within the diverter assembly.

FIG. 5 is a cross-sectional side view of an embodiment of a portion of the diverter assembly 16 having the tool 46 with a test tool packer 160 (e.g., an annular test tool packer or an annular seal). The insert packer assembly 38 includes the insert packer 56 and the test packer 58, and the tool 46 may facilitate testing of the sealing ability of the insert packer assembly 38. As shown, a respective flexible component 52 of the test tool packer 160 is axially aligned with a portion of the insert packer assembly 38. In some embodiments, the respective flexible component 52 of the test tool packer 160 is axially aligned with the test packer 58 (e.g., with the respective flexible component 52 of the test packer 58). The flexible component 52 of the test tool packer 160 is supported by rigid components 70 that are rigidly fixed to the shaft 54 of the tool 46. A fluid line 162 (e.g., conduit) may extend from a fluid source (e.g., the fluid source 70) to the flexible component 52 of the test tool packer 160, and may be configured to provide the fluid to drive the flexible component 52 of the test tool insert packer 160 radially outward from the outer wall 86 of the tool 46 toward the insert packer assembly 38.

To test the insert packer assembly 38, the fluid may be provided via the fluid line 162 to drive the flexible component 52 of the test tool packer 160 radially outward to contact the insert packer assembly 38. As shown, the flexible component 52 of the test tool packer 160 is driven radially outward to contact the flexible component 52 of the test packer 58. In some embodiments, the fluid may also be provided via the second line 76 to drive the flexible component 52 of the test packer 58 radially outward to contact the flexible component 52 of the test tool packer 160. The fluid may also be provided via the first line 74 to drive the flexible component 52 of the insert packer 56 radially outward to contact the outer wall 86 of the shaft 54 of the tool 46, thereby forming the space 88. In the illustrated embodiment, the space 88 is defined between the intermediate rigid component 70, the outer wall 86 of the shaft 54 of the tool 46, and the respective flexible components 52 of the insert packer 56, the test packer 58, and the test tool packer 160. In some embodiments, the test packer 58 may not be provided (e.g., the insert packer assembly 38 may include only a single flexible component 52), and the flexible component 52 of the test tool packer 160 may be driven radially outward to contact a portion of the rigid component 70 of the insert packer 38 or other suitable portion of the insert packer assembly 38 to facilitate formation of the space 88 between the rigid component 70, the outer wall 86 of the shaft 54 of the tool 46, and the respective flexible components 52 of the insert packer 56 and the test tool packer 160.

As discussed above, a fluid may be provided to the space 88 via a conduit in the body 44 of the diverter assembly 16 (e.g., the third line 90) and/or a conduit in the shaft 54 of the tool 46 (e.g., the fourth line 92). A pressure in the space 88 may be monitored by the sensor 94, and signals indicative of the pressure may be provided to and processed by the processor 108 of the controller 100. Additionally, as discussed above, the flexible components 52 may have any of a variety of lengths and the shaft 54 of the tool 46 may have any suitable geometry (e.g., a stepped outer wall 86 or a constant diameter) to enable testing the insert packer assembly 38. Additionally, the test tool packer 160 may be utilized in conjunction with the two-piece insert packer assembly 38 (e.g., the insert packer 56 and the test packer 58 are physically separate and each include a respective flexible component 52 supported by two rigid components 70), discussed above with reference to FIG. 2.

Figure 6:
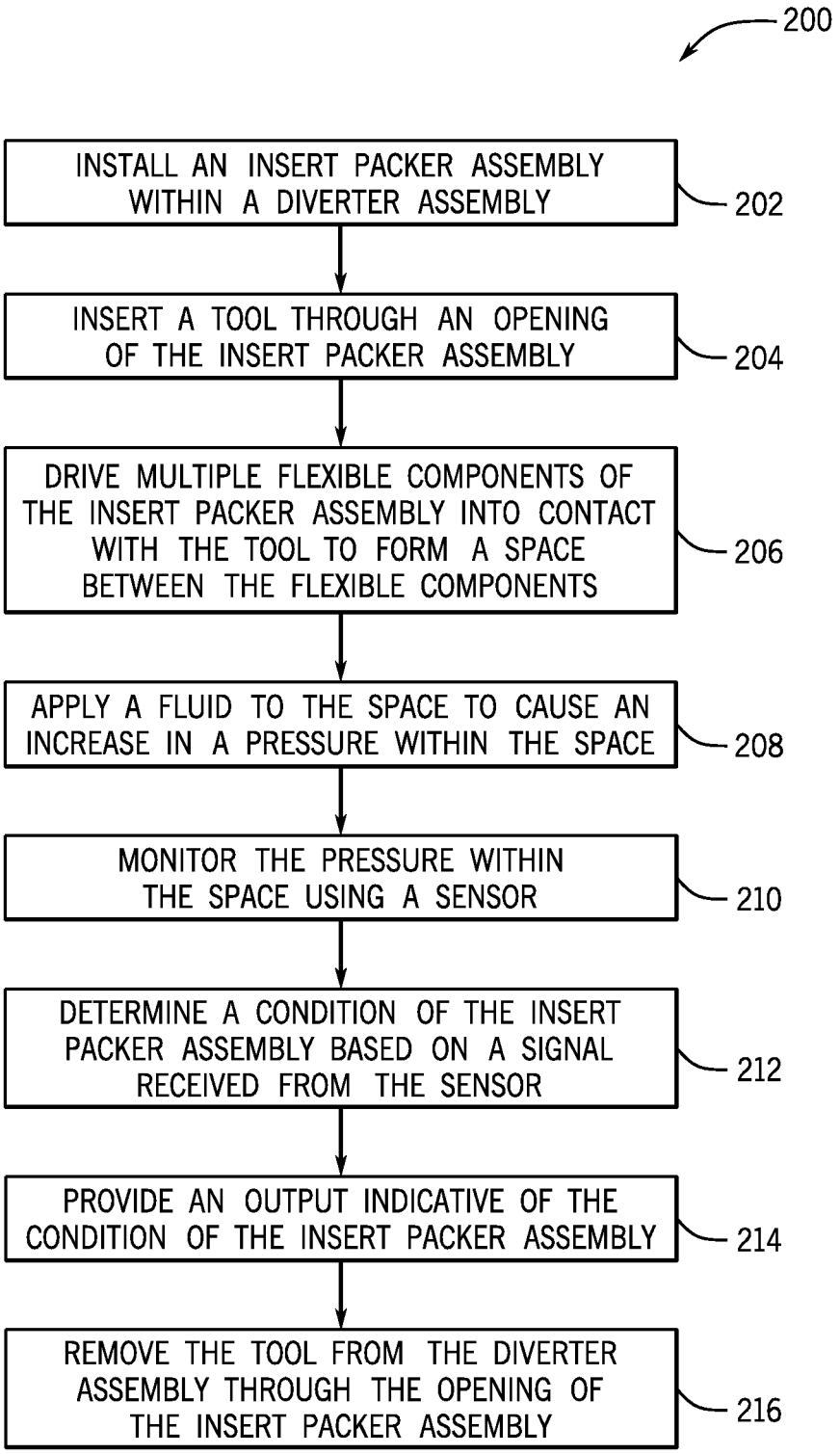
FIG. 6 is a flow diagram of an embodiment of a method for testing an insert packer assembly of a diverter assembly that may be used in the offshore system of FIG. 1.

FIG. 6 is a flow diagram of an embodiment of a method 200 for testing the insert packer assembly 38 of the diverter assembly 16. The method 200 includes various steps represented by blocks. It should be noted that at least some of the steps of the method 200 may be performed as an automated procedure controlled by a control system. Although the flow chart illustrates the steps in a certain sequence, it should be understood that the steps may be performed in any suitable order, and that certain steps may be omitted. Further, certain steps or portions of the methods may be performed by separate devices. For example, a first portion of the method may be performed an operator, while a second portion of the method may be performed by the processor 108 of the controller 100.

The method 200 may begin with installing the insert packer assembly 38 within the body 44 of the diverter assembly 16, in step 202. In some embodiments, the insert packer assembly 38 may be installed (e.g., fixed to the body 44 via one or more threaded fasteners 58, 64) by an operator and/or suitable installation equipment. In step 204, the tool 46 may be inserted through the opening 135 of the insert packer assembly 38. As discussed above, the diameter 132 of the portion of the shaft 54 of the tool 46 that is configured to pass through the opening 135 is less than the diameter 133 of the opening 135 of the insert packer assembly 38 when the insert packer assembly 38 is in the open position 50. Thus, the tool 46 may be inserted through the opening 135 of the insert packer assembly 38 and into the bore 25 of the diverter assembly 16 to test the insert packer assembly 38 without disturbing the installed insert packer assembly 38.

In step 206, the flexible components 52 of the insert packer assembly may be driven radially inward to contact the outer wall 86 of the tool 46, thereby forming the space 88 between the flexible components 52, the outer wall 86 of the tool 46, the body 44 of the diverter assembly 16, and/or the rigid components 70 of the insert packer assembly 38. In certain embodiments, a fluid may be provided from the fluid source 70 to directly or indirectly drive the flexible components 52. For example, the fluid may be provided via various lines 74, 76 to directly drive to the flexible components 52 of the insert packer 38 and/or the test packer 58 or the fluid may be provided to indirectly drive the flexible components 52 of the insert packer 38 and/or the test packer 58 via the flexible component 52 of the diverter packer 72. As discussed above, the insert packer assembly 38 and/or the tool 46 may have any of a variety of geometries or configurations to facilitate testing the seal formed by the insert packer assembly 38, and the method 200 may be adapted for use with the various disclosed embodiments.

In step 208, a fluid may be applied to the space 88 to cause an increase in a pressure within the space 88. For example, the fluid may be provided from the fluid source 70 to the space 88 via the third line 90 disposed in the body 44 of the diverter assembly 16 and/or via the fourth line 92 disposed in the shaft 54 of the tool 46. In step 210, the pressure within the space 88 may be monitored, such as by the sensor 94. The signal from the sensor 94 may be provided to the processor 108 of the controller 100, which may process the signal to determine a condition of the insert packer assembly 38, in step 212. For example, the processor 108 may determine that the seal formed by the insert packer assembly 38 is adequate if the pressure within the space 88 is maintained over a period of time or that the seal is inadequate if the pressure within the space 88 decreases over the period of time (e.g., decreases by more than 3, 5, 10, or 15 percent within 1, 3, 5, or 10 minutes). In step 214, the processor 108 may be configured to provide a displayed or an audible output indicative of the condition of the insert packer assembly 38. For example, the processor 108 may cause display of the pressure within the space 88 over the time period or display of a message indicating that the insert packer assembly 38 is or is not functioning properly.

In step 216, the tool 46 may be removed from the diverter assembly 16 through the opening 135 of the insert packer assembly 38, while the insert packer assembly 38 remains in place within the diverter assembly 16 (e.g., remains installed within or coupled to the body 44 of the diverter assembly 16 and/or without removing the one or more threaded fasteners 58, 64 that couple the insert packer assembly 38 to the body 44). Thus, the tested insert packer assembly 38 may remain in place within the diverter assembly 16 for use during drilling operations without removal of the insert packer assembly 38 after completion of testing (e.g., steps 204-210) in order to withdraw the tool 46, for example.

FIGS. 7-12 are schematic diagrams of various embodiments of a portion of the diverter assembly 16 having the insert packer assembly 38 and the tool 46 positioned within the bore 25 of the diverter assembly 16. In particular, FIGS. 7-12 illustrate a portion of the diverter assembly 16 above the central axis 45 with the insert packer assembly 38 in the unsealed position 50 in which the flexible components 52 do not contact the shaft 54 of the tool 46. It should be understood that the features of the embodiments of FIGS. 7-12 may be utilized in combination with any of the embodiments disclosed herein.

Figure 7:
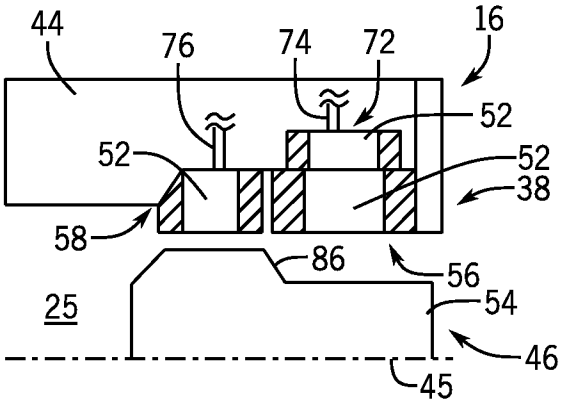
FIG. 7 is a cross-sectional side view schematic of an embodiment of a portion of a diverter assembly, wherein a tool having a stepped outer wall is disposed within the diverter assembly.

FIG. 7 illustrates a schematic diagram of an embodiment of the diverter assembly 16 similar to that depicted in FIG. 2. In particular, the insert packer assembly 38 includes the separate test packer 58 and the insert packer 56. The diverter packer 72 is coupled to the body 44. In the illustrated embodiment, fluid may be applied to the respective flexible component 52 of the diverter packer 72 via the first line 74, causing the respective flexible components 52 of the diverter packer 72 and the insert packer 56 to be driven radially inward toward the shaft 54 of the tool 46. Additionally, in the illustrated embodiment of FIG. 7, the second line 76 may provide the fluid to the flexible component 52 of the test packer 58, thereby directly driving the flexible component 52 of the test packer 58 radially inward toward the shaft 54 of the tool 46. The shaft 54 of the tool 46 has the stepped outer wall 86.

Figure 8:
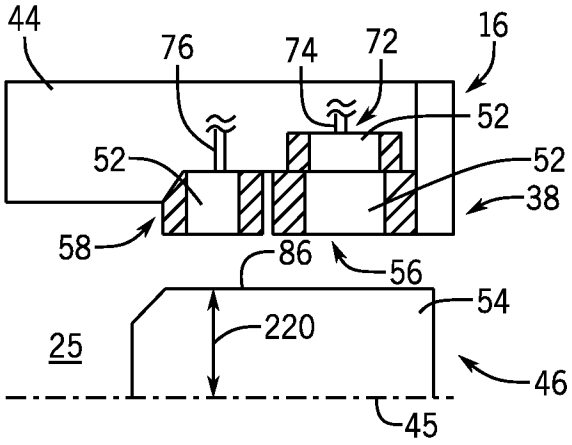
FIG. 8 is a cross-sectional side view schematic of an embodiment of a portion of a diverter assembly, wherein a tool having an outer wall with a uniform diameter is disposed within the diverter assembly.

FIG. 8 illustrates a schematic diagram of an embodiment of the diverter assembly 16 similar to that of FIG. 7. In FIG. 8, the shaft 54 of the tool 46 does not have the stepped outer wall 86 of FIG. 7, but rather, the shaft 54 (e.g., the portions of the shaft 54 disposed within and/or axially aligned with the flexible components 52 of the insert packer assembly 38 during testing) are generally cylindrical and have a substantially constant diameter 220.

Figure 9:
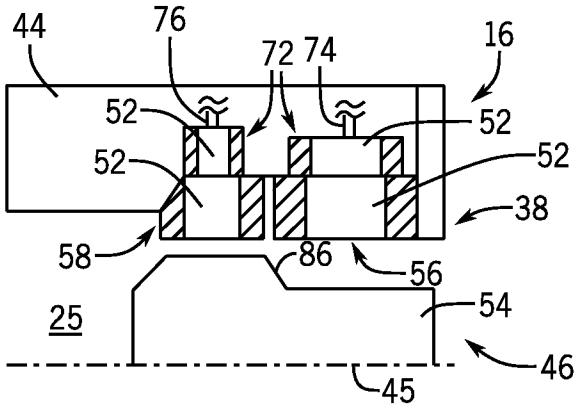
FIG. 9 is a cross-sectional side view schematic of an embodiment of a portion of a diverter assembly having multiple diverter packers, wherein a tool having a stepped outer wall is disposed within the diverter assembly.

FIG. 9 illustrates a schematic diagram of an embodiment of the diverter assembly 16 similar to that of FIG. 7. In FIG. 9, two diverter packers 70 are provided. One diverter packer 70 is aligned with the test packer 58, and one diverter packer is aligned with the insert packer 56. The first line 74 and/or the second line 76 may apply the fluid to respective diverter packers 72 to indirectly drive the flexible components 52 of the insert packer 56 and/or the test packer 58 radially inward.

Figure 10:
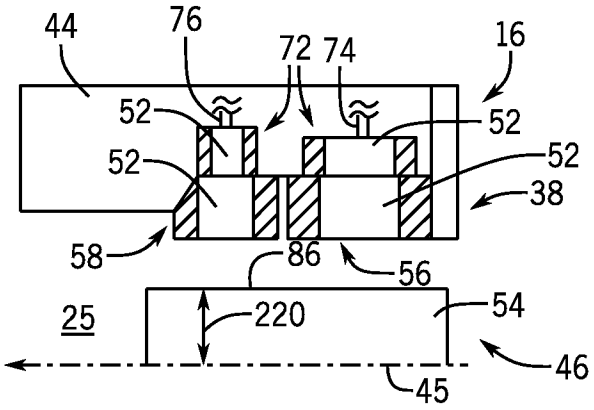
FIG. 10 is a cross-sectional side view schematic of an embodiment of a portion of a diverter assembly having multiple diverter packers, wherein a tool having an outer wall with a uniform diameter is disposed within the diverter assembly.

FIG. 10 illustrates a schematic diagram of an embodiment of the diverter assembly 16 similar to that of FIG. 9. In FIG. 10, the shaft 54 of the tool 46 does not have the stepped outer wall 86 of FIG. 9, but rather, the shaft 54 (e.g., the portions of the shaft 54 disposed within and/or axially aligned with the flexible components 52 of the insert packer assembly 38 during testing) are generally cylindrical and have a substantially constant diameter 220.

Figure 11:
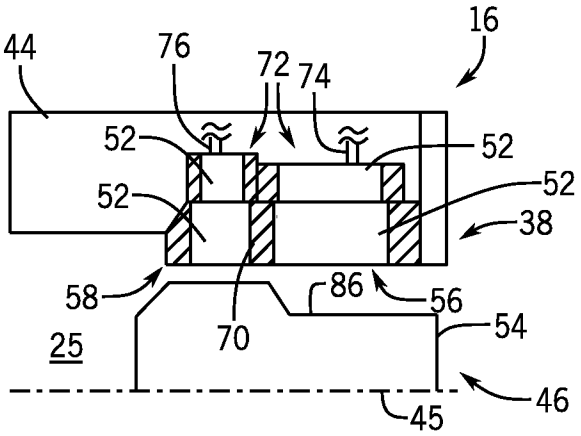
FIG. 11 is a cross-sectional side view schematic of an embodiment of a portion of a diverter assembly having a one-piece insert packer assembly, wherein a tool having a stepped outer wall is disposed within the diverter assembly.

FIG. 11 illustrates a schematic diagram of an embodiment of the diverter assembly 16 similar to that of FIG. 9. In FIG. 11, the insert packer assembly 38 is a one-piece insert packer assembly 38 in which the insert packer 56 and the test packer 58 are coupled to one another (e.g., fixed to one another) or are integrally formed into a single structure. For example, the one-piece insert packer assembly 38 includes two physically separate and distinct axially-spaced flexible components 52 (e.g., non-contacting and separated from one another along the axial axis 30). As shown, the flexible components 52 are separated from one another by a single rigid component 70 that extends between and contacts the two flexible components 52. It should be understood the one-piece insert packer assembly 38 may be utilized in conjunction with two diverter packers 72, as shown, or one or both lines 74, 76 may provide fluid directly to the flexible components 52 of the one-piece insert packer assembly 38 in the manner described above with respect to FIG. 7, for example.

Figure 12:
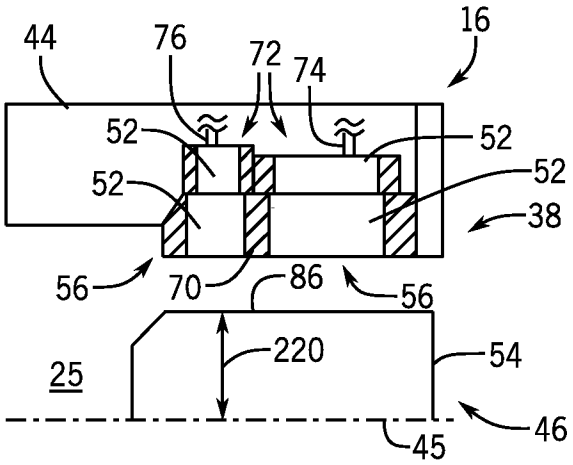
FIG. 12 is a cross-sectional side view schematic of an embodiment of a portion of a diverter assembly having a one-piece insert packer assembly, wherein a tool having an outer wall with a uniform diameter is disposed within the diverter assembly.

FIG. 12 illustrates a schematic diagram of an embodiment of the diverter assembly 16 similar to that of FIG. 11. In FIG. 12, the shaft 54 of the tool 46 does not have the stepped outer wall 86 of FIG. 12, but rather, the shaft 54 (e.g., the portions of the shaft 54 disposed within and/or axially aligned with the flexible components 52 of the insert packer assembly 38 during testing) are generally cylindrical and have a substantially constant diameter 220.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method for testing an insert packer assembly positioned within a diverter assembly, the method comprising:

inserting a test tool through an opening of the insert packer assembly and into a bore of the diverter assembly;

driving multiple annular flexible components of the insert packer assembly radially inward to contact an outer annular surface of the test tool to form a sealed space located axially between the multiple annular flexible components along an axial axis of the insert packer assembly;

applying a fluid to the sealed space to increase a pressure within the sealed space; and monitoring the pressure within the sealed space over a period of time to determine a sealing condition of the insert packer assembly relative to the test tool.

2. The method of claim 1, comprising removing the test tool from the diverter assembly through the opening of the insert packer assembly while leaving the multiple annular flexible components of the insert packer assembly in place within the diverter assembly.

3. The method of claim 1, wherein monitoring the pressure within the sealed space comprises measuring the pressure using a sensor positioned within the sealed space, generating a signal indicative of the pressure using the sensor, and providing the signal to a processor that is configured to process the signal to the determine the sealing condition of the insert packer assembly relative to the test tool.

4. The method of claim 3, comprising providing, using the processor, instructions that cause a display to provide a displayed output indicative of the sealing condition of the insert packer assembly relative to the test tool.

5. The method of claim 1, wherein applying the fluid to the sealed space comprises applying the fluid to the sealed space via a conduit extending through a shaft of the test tool.

6. The method of claim 2, comprising driving the multiple annular flexible components radially inward to contact and to form respective seals about a drill string during drilling operations.

7. The method of claim 1, comprising:

monitoring the pressure within the sealed space over the period of time using a sensor;

generating, using the sensor, a signal indicative of the pressure within the sealed space of the period of time;

receiving, at a processor, the signal indicative of the pressure within the sealed space over the period of time; and determining, using the processor, that the pressure within the sealed space is not substantially maintained over the period of time based on the signal; and determining, using the processor, that the sealing condition of the insert packer assembly relative to the test tool is inadequate in response to the pressure within the sealed space not being substantially maintained over the period of time.

8. A system, comprising:

an insert packer assembly configured to be disposed within a diverter assembly, wherein the insert packer assembly comprises multiple flexible annular components configured to be axially spaced apart from one another along an axial axis of the insert packer assembly; and a test tool configured to be removably inserted through an opening of the insert packer assembly and through each of the multiple flexible annular components;

wherein the multiple flexible annular components are configured to move in a radial direction between a first position and a second position to contact and to form a seal against the test tool, thereby enabling testing of a sealing condition of the seal formed by the multiple flexible annular components of the insert packer assembly against the test tool.

9. The system of claim 8, wherein a first diameter of the test tool is less than a second diameter of the opening of the insert packer assembly when the multiple flexible annular components are in the first position to facilitate insertion of the test tool and removal of the test tool through the opening.

10. The system of claim 8, wherein a first flexible annular component of the multiple flexible annular components has a first axial length and a second flexible annular component of the multiple flexible annular components has a second axial length, less than the first axial length.

11. The system of claim 10, wherein the test tool comprises a stepped outer wall such that a first portion of the test tool comprises a first diameter and a second portion of the test tool comprises a second diameter, greater than the first diameter, and wherein the first portion of the test tool is configured to be aligned with the first flexible annular component along the axial axis and the second portion is configured to be aligned with the second flexible annular component along the axial axis when the test tool is positioned within the opening of the insert packer assembly and during testing of the sealing condition of the seal formed by the multiple flexible annular components of the insert packer assembly against the test tool.

12. The system of claim 8, wherein the multiple flexible annular components of the insert packer assembly comprise two flexible annular components axially spaced apart from one another and each supported by a single rigid component that is disposed between and contacts each of the two flexible annular components.

13. The system of claim 8, wherein the insert packer assembly comprises an insert packer and a test packer that are each coupled to a body of the diverter assembly via one or more fasteners, the insert packer and the test packer do not contact one another, and the insert packer and the test packer each comprise one of the multiple flexible annular components supported between two annular rigid components.

14. The system of claim 8, comprising a conduit configured to provide a fluid from a fluid source to a sealed space formed between the multiple flexible annular components when the multiple flexible annular components are in the second position, wherein the conduit extends through a shaft of the test tool to the sealed space.

15. The system of claim 8, comprising a sensor configured to monitor a pressure within a sealed space formed between the multiple flexible annular components when the multiple flexible annular components are in the second position to enable testing of the sealing condition of the seal formed by the multiple flexible annular components of the insert packer assembly against the test tool.

16. The system of claim 8, wherein the test tool comprises an annular expansion piece that is configured to be removably coupled to a radially-outer wall of a main body of the test tool to increase a total diameter of the test tool to facilitate testing of the sealing condition of the seal formed by the multiple flexible annular components of the insert packer assembly against the test tool, wherein at least one of the multiple flexible annular components contacts and seals against the annular expansion piece of the test tool when the multiple flexible annular components are in the second position.

17. The system of claim 15, wherein the sensor is coupled to the test tool such that the sensor is inserted and removed from the opening of the insert packer assembly with the test tool.

18. A system, comprising:

an insert packer assembly comprising multiple flexible annular components that are configured to be disposed within a diverter assembly; and a test tool configured to be inserted into and withdrawn from an opening of the insert packer assembly, wherein the multiple flexible annular components are configured to be coaxial and axially spaced apart from one another when the insert packer assembly is disposed within the diverter assembly, and are configured to move in a radial direction between a first position which enables the test tool to be inserted into and withdrawn from the opening of the insert packer assembly and a second position in which a sealed space is defined at least in part by the multiple flexible annular components and an outer wall of the test tool to facilitate testing of a sealing condition of the insert packer assembly relative to the test tool.

19. The system of claim 18, wherein the test tool comprises a test tool packer comprising a respective flexible annular component that is configured to move radially outward to contact at least one of the multiple flexible annular components of the insert packer assembly when the test tool is inserted into the opening of the insert packer assembly and during testing of the sealing condition of the insert packer assembly relative to the test tool.

20. The system of claim 18, wherein the multiple flexible annular components are part of one or more insert packers that are coupled to a body of the diverter assembly.

21. The system of claim 18, comprising:

a sensor configured to monitor a pressure within the sealed space and to generate a signal indicative of the pressure within the sealed space; and a processor configured to receive the signal, to determine that the sealing condition of the insert packer assembly relative to the test tool is adequate when the signal indicates that the pressure with the sealed space is substantially maintained for a period of time, and to determine that the sealing condition of the insert packer assembly relative to the test tool is inadequate when the signal indicates that the pressure within the sealed space is not substantially maintained for the period of time.

* * * * *